US008851938B2

(12) United States Patent
Taguchi et al.

(10) Patent No.: US 8,851,938 B2
(45) Date of Patent: Oct. 7, 2014

(54) TERMINAL CONNECTION STRUCTURE

(71) Applicant: Yazaki Corporation, Tokyo (JP)

(72) Inventors: Naoto Taguchi, Shizuoka (JP); Masaru Shimizu, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 28 days.

(21) Appl. No.: 13/890,858

(22) Filed: May 9, 2013

(65) Prior Publication Data

US 2013/0244508 A1 Sep. 19, 2013

Related U.S. Application Data

(63) Continuation of application No. PCT/JP2011/076748, filed on Nov. 15, 2011.

(30) Foreign Application Priority Data

Nov. 15, 2010 (JP) ..... 2010-254810

(51) Int. Cl.

| | |
|---|---|
| ***H01R 13/187*** | (2006.01) |
| ***H01R 4/48*** | (2006.01) |
| ***H01R 13/11*** | (2006.01) |
| ***H01H 85/143*** | (2006.01) |
| ***H01R 13/15*** | (2006.01) |
| ***H01H 85/20*** | (2006.01) |
| *H01H 85/055* | (2006.01) |

(52) U.S. Cl.

CPC ..... *H01R 4/48* (2013.01); *H01R 13/113* (2013.01); *H01H 85/143* (2013.01); *H01R 4/4818* (2013.01); *H01H 2085/0555* (2013.01); *H01R 13/15* (2013.01); *H01H 85/203* (2013.01)

USPC ..... 439/816; 439/833; 439/858; 439/818; 439/828; 439/830

(58) Field of Classification Search

USPC ..... 439/816, 818, 828, 830, 833, 858

See application file for complete search history.

(56) References Cited

U.S. PATENT DOCUMENTS

| | | | | |
|---|---|---|---|---|
| 4,992,062 | A * | 2/1991 | Nakayama et al. | 439/620.26 |
| 2004/0124963 | A1 | 7/2004 | Nakamura | |
| 2006/0223385 | A1 * | 10/2006 | Pavlovic et al. | 439/858 |
| 2014/0045387 | A1 * | 2/2014 | Furuya et al. | 439/746 |

FOREIGN PATENT DOCUMENTS

| | | | |
|---|---|---|---|
| DE | 7537982 | U | 9/1978 |
| DE | 19708911 | C1 | 7/1998 |
| GB | 2228150 | A | 8/1990 |
| JP | 2004-127703 | A | 4/2004 |

* cited by examiner

*Primary Examiner* — Dameon E Levi
*Assistant Examiner* — Matthew T Dzierzynski
(74) *Attorney, Agent, or Firm* — Kenealy Vaidya LLP

(57) ABSTRACT

A terminal connection structure comprises a first terminal made in a plate shape and formed with a through-opening, a supporting section supporting the first terminal, a second terminal made in a plate shape and to be a connection counterpart of the first terminal, and a clip made of a plate-like material having an electrical conductivity, and having a central piece formed into a U-shape and opposed pieces continued from the central piece, the central piece being provided with a pair of projection portions projected from both side portions of the central piece to prevent the clip from excessively entering into the through-opening. The first terminal is interposed between the opposed pieces facing to each other with the central piece inserted into the through-opening, and the second terminal is inserted between a surface of the first terminal facing the pair of projection portions and the clip.

4 Claims, 9 Drawing Sheets

TERMINAL CONNECTION STRUCTURE

CROSS REFERENCE TO RELATED APPLICATION

This application is a continuation of PCT application No. PCT/JP2011/076748, which was filed on Nov. 15, 2011 based on Japanese Patent Application (No. 2010-254810) filed on Nov. 15, 2010, the contents of which are incorporated herein by reference. Also, all the references cited herein are incorporated as a whole.

BACKGROUND OF THE INVENTION

1. Field of the Invention

The present invention relates to a terminal connection structure which connects terminals.

2. Description of the Related Art

Hereinbefore, a terminal connection structure that connects terminals by using a bolt and a nut has been used. In such a terminal connection structure, in order not to interfere with fastening work, a protruding portion is not provided on a terminal surface on which the bolt is mounted as much as possible. For example, it is disclosed in JP-A-2004-127703 that a terminal connection structure is configured such that a claw portion fixing a terminal to a terminal support portion does not protrude from a terminal surface.

The terminal connection structure described in JP-A-2004-127703 is configured such that a pair of inclined portions inclined to the rear surface side of a terminal is provided at both end sides of the terminal and a pair of claw portions is provided so as to cover the pair of inclined portions. In such a manner, since the claw portions do not protrude from the terminal surface on which the bolt is mounted, the claw portions do not interfere with fastening work of the terminal by a bolt and a nut.

However, in the terminal connection structure described in JP-A-2004-127703, there is possibility in that the fastening work of the terminal using a bolt and a nut is required and a great deal of time is required for the fastening work.

SUMMARY OF THE INVENTION

The present invention has been made in view of these situation and possibility. It has an object to provide a terminal connection structure which can reduce time required for connection work of a terminal.

In order to achieve the object, a terminal connection structure according to a first aspect of the invention includes: a terminal connection structure, comprising a first terminal that is made in a plate shape and formed with a through-opening; a supporting section supporting the first terminal; a second terminal that is made in a plate shape and to be a connection counterpart of the first terminal; and a clip made of a plate-like material having an electrical conductivity, and having a central piece formed into a U-shape and opposed pieces continued from the central piece, the central piece being provided with a pair of projection portions projected from both side portions of the central piece so as to prevent the clip from excessively entering into the through-opening; wherein the first terminal is interposed between the opposed pieces facing to each other with the central piece inserted into the through-opening; and the second terminal is inserted between a surface of the first terminal facing the pair of projection portions and the clip.

Further, the terminal connection structure according to a second aspect of the invention is characterized in that the first terminal is a terminal provided with a bus bar.

Further, the terminal connection structure according to a third aspect of the invention is characterized in that the second terminal has a locking hole to be locked by the first terminal, and the first terminal has a locking portion to be engaged with the locking hole so as to lock the second terminal to the first terminal, and the locking portion is provided in ahead of the through-opening in an insertion direction of the second terminal.

Further, a fusible link according to a fourth aspect of the invention is characterized in that a fusible link comprising the terminal connection structure according to the first aspect of the invention.

In the terminal connection structure according to the first aspect of the invention, when the second terminal is inserted between the surface facing the pair of projection portions side among the surfaces of the first terminal and the clip, since excessively entering the clip into the through-opening is restricted by the pair of projection portions and the clip pinches the second terminal so as to come into close contact with the first terminal, the first terminal and the second terminal can be connected to each other only by inserting the second terminal, and as a result, it is possible to reduce time required for connection work of a terminal.

In the terminal connection structure according to the second aspect of the invention, it is possible to reduce time required for connection work of the terminal provided at the bus bar.

In the terminal connection structure according to the third aspect of the invention, since the locking hole of the second terminal is locked by the locking portion of the first terminal, it is possible to position the second terminal with respect to the first terminal and also to prevent dislodging of the second terminal from the first terminal.

Since the fusible link according to the fourth aspect of the invention has the clip and the first terminal described in the first aspect, it is possible to reduce time required for connection work of the terminal provided at the bus bar and also to allow the terminal provided at the bus bar and the second terminal which is an external terminal to be connected to each other by the clip. Therefore, it is possible to take a compact configuration, compared to a fusible link in which a terminal is connected by a bolt and a nut.

DESCRIPTION OF THE PREFERRED EMBODIMENTS

Hereinafter, a preferred embodiment of a terminal connection structure related to the invention will be described in detail with reference to the drawings.

Figure 1:
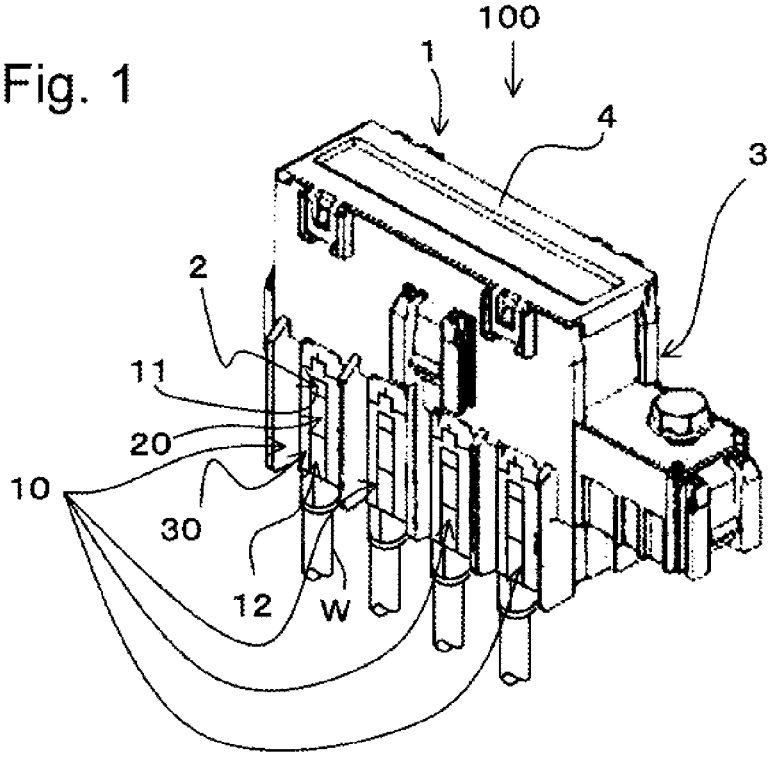
FIG. 1 is a perspective view showing the configuration of a fusible link unit having a terminal connection structure related to an embodiment of the invention.

FIG. 1 is a perspective view showing the configuration of a fusible link unit 100 having a terminal connection structure related to an embodiment of the invention. The fusible link unit 100 having a terminal connection structure 10 related to the embodiment of the invention is for supplying electric power from an electric power supply source such as a battery to each electrical component through a fuse circuit. The fusible link unit 100 has a plurality of tab terminals 12 to which a fusible link 1 and an electric wire W are connected.

The fusible link 1 has a bus bar 2, a housing 3, and a transparent cover 4.

The bus bar 2 is a fuse circuit integrally formed by press-working an electrically-conductive plate material. The bus bar 2 has a plurality of bus bar terminals 11. The bus bar terminal 11 is a terminal connected to the tab terminal 12, as a first terminal. Each bus bar terminal 11 is connected to the electric power supply source through a fusible body (not shown). The fusible body is a low-melting-point metal portion provided at the bus bar 2 and is made so as to be melted and cut when an electric current of a predetermined value or more is conducted.

The housing 3 is formed by insulating synthetic resin so as to have an external shape of an approximately rectangular parallelepiped shape and has an opening formed at an upper portion of the housing 3. In the inside of the housing 3, an accommodating chamber which supports the bus bar 2 is formed, and at a lower portion of the accommodating chamber, a plurality of connector housings 30 is formed. The connector housing 30 is for supporting the bus bar terminal 11 at a predetermined position as a supporting section. The transparent cover 4 is for covering the opening formed at the upper portion of the housing 3.

The tab terminal 12 is a terminal connected to the electric wire W which is connected to an electrical component to be an electric power supply destination. The tab terminal 12 is a terminal to be a connection counterpart of the bus bar terminal 11, as a second terminal. The tab terminal 12 is connected to the bus bar terminal 11, whereby electric power which is supplied from the electric power supply source is supplied to each electrical component through the electric wire W.

Figure 2:
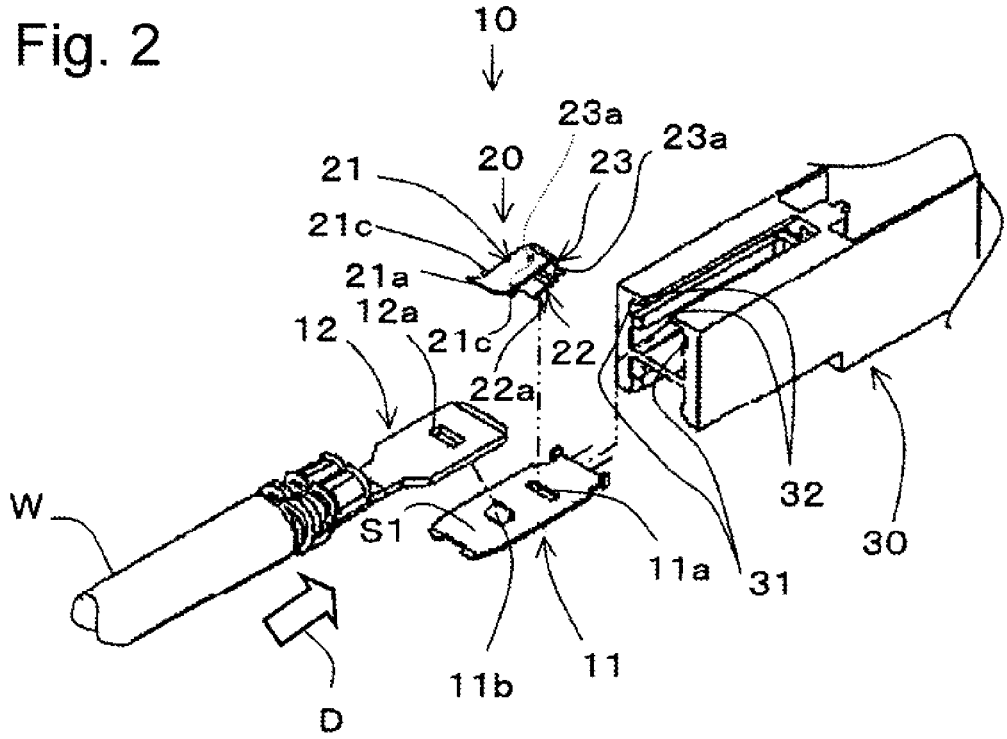
FIG. 2 is an exploded perspective view of the terminal connection structure shown in FIG. 1.
Figure 3:
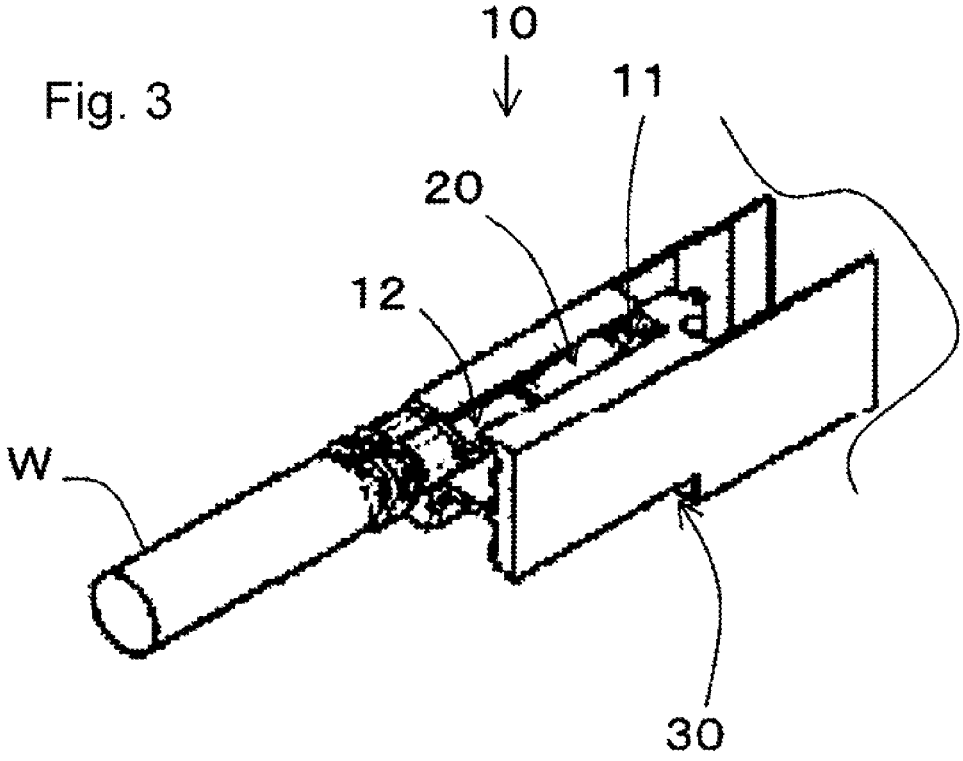
FIG. 3 is a perspective view of the terminal connection structure shown in FIG. 1.
Figure 4:
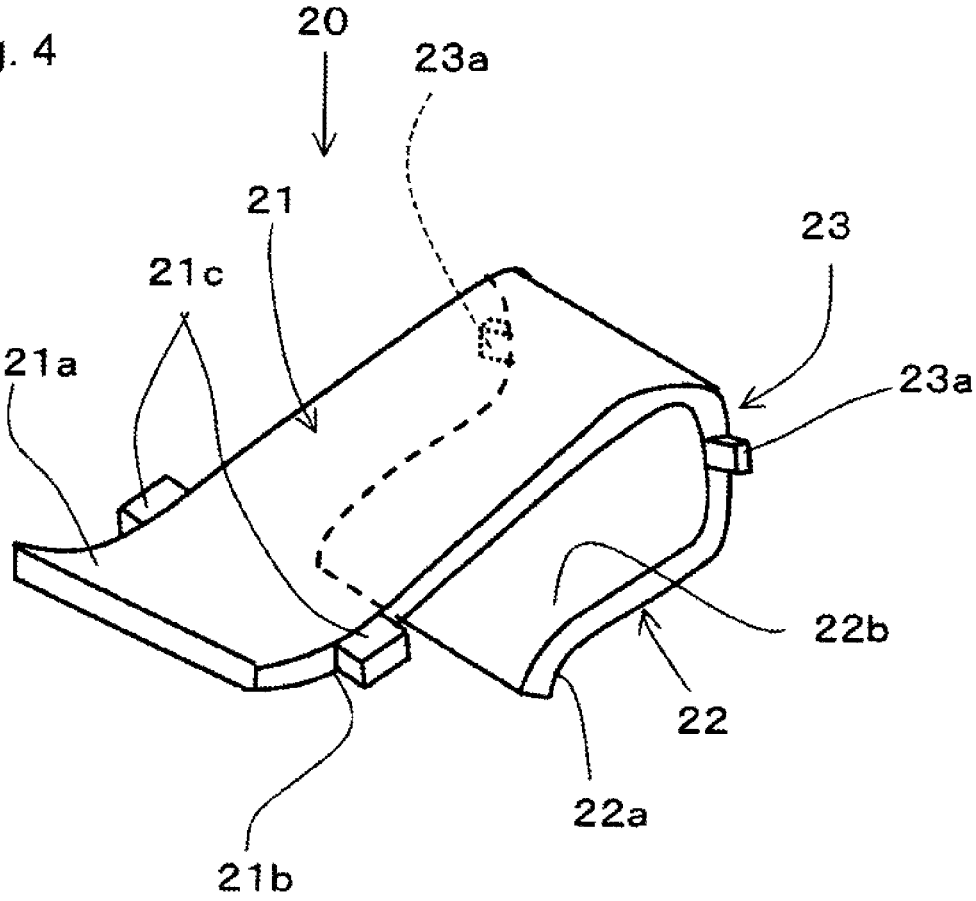
FIG. 4 is an enlarged view of a connection clip shown in FIG. 2.
Figure 5:
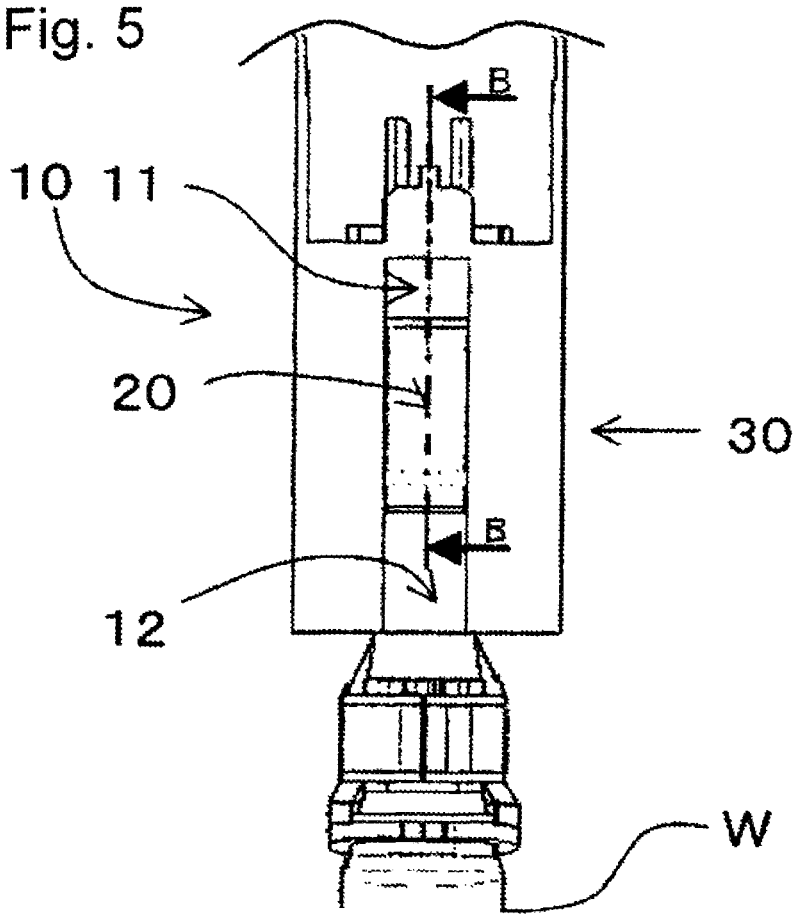
FIG. 5 is a front view of the terminal connection structure shown in FIG. 1.
Figure 6:
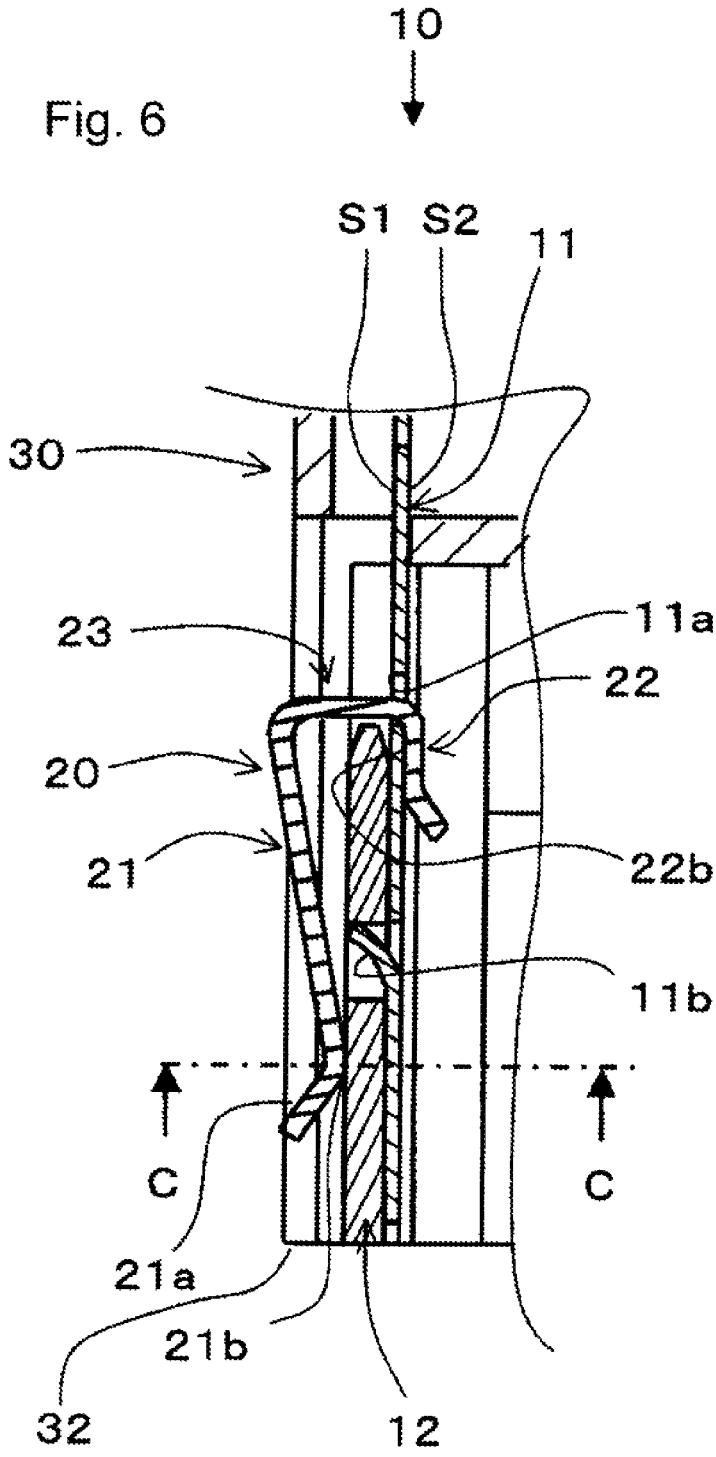
FIG. 6 is a cross-sectional view taken along line B-B of the terminal connection structure shown in FIG. 5.
Figure 7:
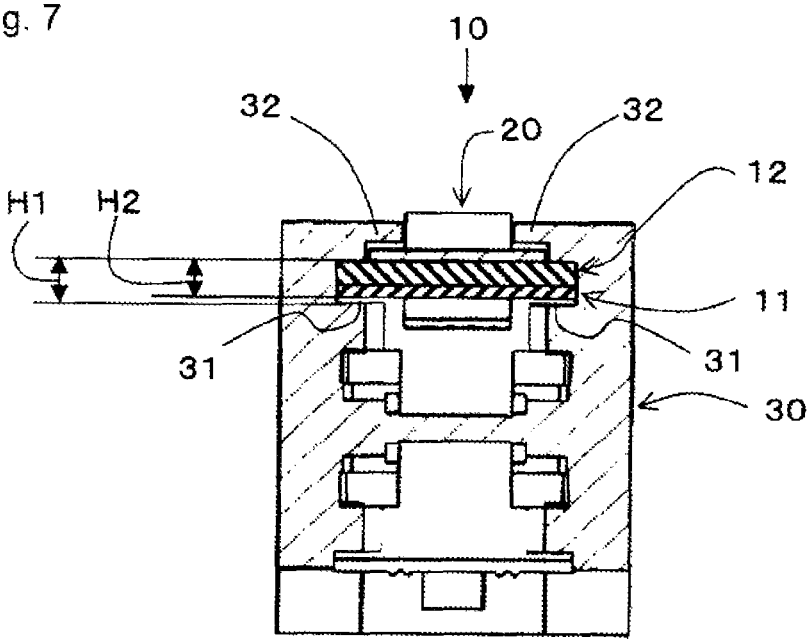
FIG. 7 is a cross-sectional view taken along line C-C of the terminal connection structure shown in FIG. 6.
Figure 8:
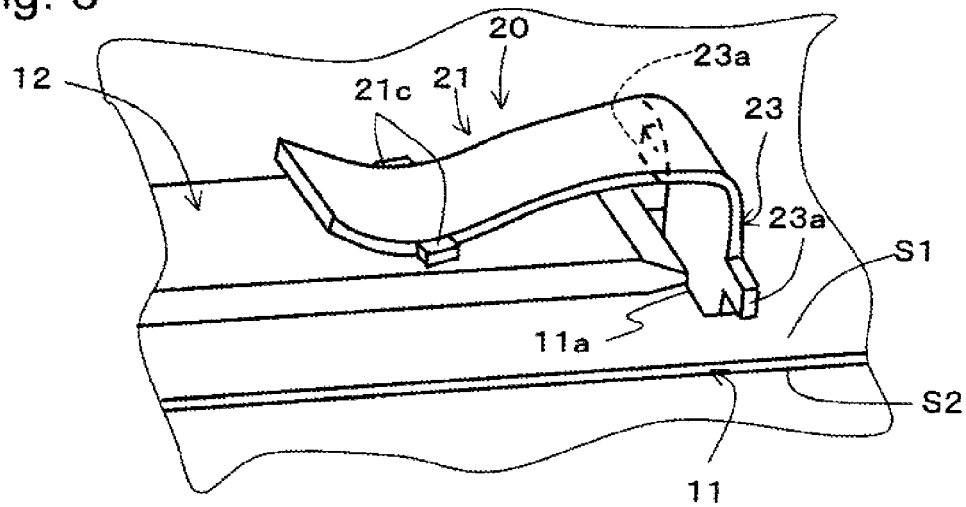
FIG. 8 is a diagram for describing projection portions.

Here, the terminal connection structure in which the tab terminal 12 is connected to the bus bar terminal 11 in close contact with the bus bar terminal 11 will be specifically described using FIGS. 2 to 7. FIG. 2 is an exploded perspective view of the terminal connection structure shown in FIG. 1. FIG. 3 is a perspective view of the terminal connection structure shown in FIG. 1. FIG. 4 is an enlarged view of a connection clip shown in FIG. 2. FIG. 5 is a front view of the terminal connection structure shown in FIG. 1. FIG. 6 is a cross-sectional view taken along line B-B of the terminal connection structure shown in FIG. 5. FIG. 7 is a cross-sectional view taken along line C-C of the terminal connection structure shown in FIG. 6. FIG. 8 is a diagram for describing projection portions. In addition, an arrow direction in FIG. 2 indicates an insertion direction of the tab terminal.

The terminal connection structure 10 has the bus bar terminal 11, the tab terminal 12, a fastening clip 20, and the connector housing 30, as shown in FIG. 2.

The bus bar terminal 11 is made in a plate shape and has a through-opening 11*a* formed therein. The bus bar terminal 11 has a locking fin 11*b*.

The through-opening 11*a* is formed into a rectangular shape and is a hole for inserting a portion of the fastening clip 20 in a case where the fastening clip 20 is mounted on the bus bar terminal 11.

The locking fin 11*b* is formed by cutting and raising a portion of the bus bar terminal 11. The locking fin 11*b* is provided ahead of the through-opening 11*a* in an insertion direction D of the tab terminal 12. The locking fin 11*b* is engaged with a locking hole 12*a* of the tab terminal 12.

The tab terminal 12 is made in a plate shape and has the locking hole 12*a* of a rectangular shape formed therein. The locking hole 12*a* is engaged with the locking fin 11*b* of the bus bar terminal 11. That is, the locking hole 12*a* is a hole for being locked by the bus bar terminal 11. In a case where the tab terminal 12 is connected to the bus bar terminal 11, with engagement of the locking fin 11*b* with the locking hole 12*a*, the tab terminal 12 is positioned with respect to the bus bar terminal 11 and also prevented from dislodging from the bus bar terminal 11.

The fastening clip 20 is made of a plate-like material having electrical conductivity and elasticity, the fastening clip is bended and formed into an approximate U-shape. The fastening clip 20 is mounted on the bus bar terminal 11 by inserting a U-shaped bottom-side plate-like portion of the fastening clip 20 into the through-opening 11*a* of the bus bar terminal 11.

The fastening clip 20 has a central piece 23 and opposed pieces 21 and 22 continued from the central piece 23, as shown in FIG. 4. The respective opposed pieces 21 and 22 are provided so as to be bent from the central piece 23 such that the distance between the opposed pieces 21 and 22 becomes shorter as they separate from the central piece 23.

The opposed piece 21 is a portion on the long dimension side among the opposed plate-like portions of the fastening clip 20. The opposed piece 21 has a curved portion 21*a*, a tab terminal contact portion 21*b*, and a pair of protruding portions 21*c* and 21*c*. The curved portion 21*a* is a portion formed by curving an end portion of the opposed portion 21.

The tab terminal contact portion 21*b* is a portion which comes into contact with the tab terminal 12 in a case where the tab terminal 12 has been inserted between the bus bar terminal 11 and the opposed pieces 21. The protruding portions 21*c* and 21*c* are portions which protrude from both side portions of the opposed piece 21.

The opposed piece 22 is a portion on the short dimension side among the opposed plate-like portions of the fastening clip 20. The opposed piece 22 has a curved portion 22*a* and a bus bar terminal contact portion 22*b*. The curved portion 22*a* is a portion formed by curving an end portion of the opposed portion 22.

The bus bar terminal contact portion 22*b* is a portion which comes into contact with the bus bar terminal 11 in a case where the fastening clip 20 has been mounted on the bus bar terminal 11.

The central piece 23 is the U-shaped bottom-side plate-like portion. The central portion 23 is provided with a pair of projection portions 23*a* and 23*a*. The projection portions 23*a* and 23*a* are portions which protrude from both side portions of the central piece 23. More specifically, the projection portions 23*a* and 23*a* regulates the movement of the fastening clip 20 toward the through-opening 11*a* so as to prevents the fastening clip 20 from excessively entering into the through-opening 11*a*, by setting the projection portions 23*a* and 23*a* to be a size which comes into contact with the surface of the bus bar terminal 11, as shown in FIG. 8.

The connector housing 30 has an approximately rectangular parallelepiped shape and is for supporting the bus bar terminal 11 with the fastening clip 20 mounted thereon. In the connector housing 30, an opening for inserting the tab terminal 12 is formed at a lower portion thereof. The connector housing 30 has guide grooves 31 and clip guide portions 32, as shown in FIG. 7.

The guide grooves 31 are provided facing each other so as to support both side portions of the bus bar terminal 11. A groove width H1 of the guide groove 31 is set to be large compared to a thickness H2 in a superposed state of the bus bar terminal 11 and the tab terminal 12. The guide grooves 31 serve as guides in the case of inserting the bus bar terminal 11 from above the connector housing 30 and also support the bus bar terminal 11 at a predetermined position.

The clip guide portions 32 are protruding portions which protrude to the inside of the connector housing 30 so as to cover the protruding portions 21*c* of the fastening clip 20. The clip guide portions 32 restrict the upward movement of the fastening clip 20. That is, the clip guide portions 32 prevent the interval between the opposed pieces 21 and 22 of the fastening clip 20 from excessively widening.

Figures 9A, 9B, 9C:
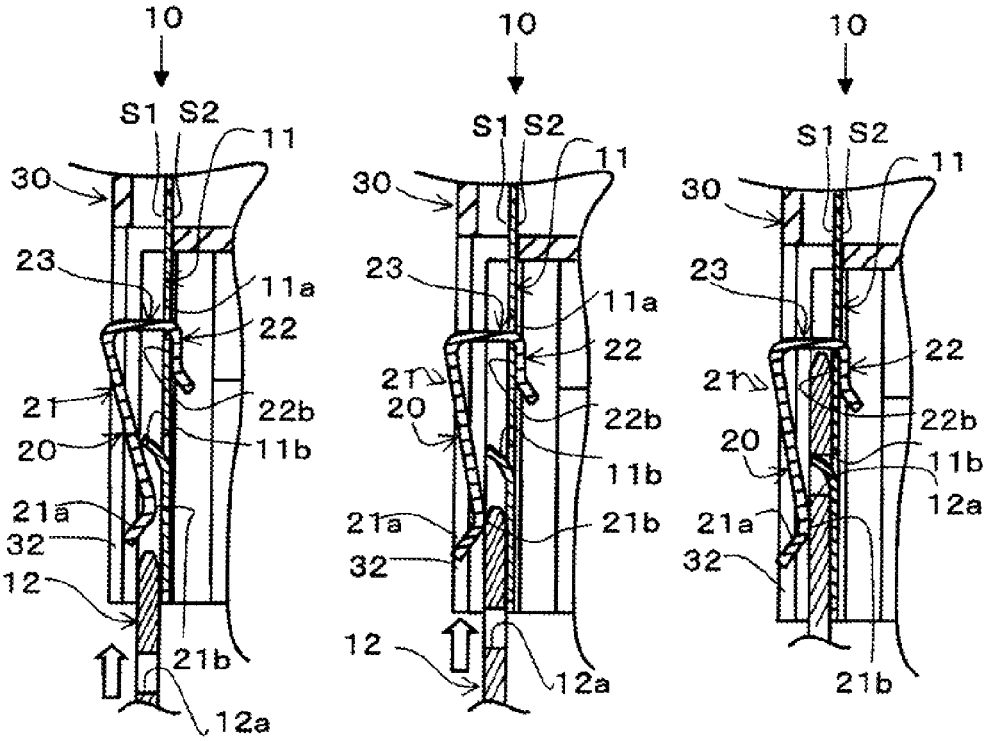
FIGS. 9 (*a*), 9(*b*) and 9(*c*) are diagrams showing the procedure of connecting a bus bar terminal and a tab terminal.

Next, the procedure of connecting the bus bar terminal 11 and the tab terminal 12 will be describing using FIGS. 9 (*a*), 9(*b*) and 9(*c*). FIGS. 9 (*a*), 9(*b*) and 9(*c*) are diagrams showing the procedure of connecting the bus bar terminal 11 and the tab terminal 12.

First, insertion of the tab terminal 12 from the opening of the lower portion of the connector housing 30 is started. In addition, when inserting the tab terminal 12, the tab terminal 12 is set to be inserted between a surface S1 facing the pair of projection portions 23*a* and 23*a* side among surfaces S1 and S2 of the bus bar terminal 11 and the fastening clip 20. Further, the tab terminal 12 is inserted while the side portions of the tab terminal 12 are guided by the guide grooves 31 of the connector housing 30 (refer to FIG. 9(*a*)).

Thereafter, if the tab terminal 12 is inserted upward, a leading end portion of the tab terminal 12 comes into contact with the tab terminal contact portion 21*b* of the fastening clip 20, thereby pushing and widening the fastening clip 20 against the spring force of the fastening clip 20. Since the fastening clip 20 has the curved portion 21*a*, the tab terminal 12 is smoothly inserted between the fastening clip 20 and the bus bar terminal 11 (refer to FIG. 9(*b*)). In such a manner, the tab terminal 12 is inserted between the surface S1 facing the pair of projection portions 23*a* and 23*a* side among the surfaces S1 and S2 of the bus bar terminal 11 and the fastening clip 20.

Thereafter, if the tab terminal 12 is further inserted upward, the locking fin 11*b* of the bus bar terminal 11 is engaged with the locking hole 12*a* of the tab terminal 12 (refer to FIG. 9(*c*)). Due to this, it is confirmed that the tab terminal 12 has been inserted up to a predetermined position. In this manner, in a state where insertion of the bus bar terminal 11 and the tab terminal 12 has been completed, the fastening clip 20 brings the bus bar terminal 11 and the tab terminal 12 into close contact with each other by the spring force. More specifically, the fastening clip 20 pinches the bus bar terminal 11 and the tab terminal 12 in a superposed state by bringing the tab terminal contact portion 21*b* into contact with the tab terminal 12 and bringing the bus bar terminal contact portion 22*b* into contact with the bus bar terminal 11. That is, the bus bar terminal 11 and the tab terminal 12 come into contact with each other.

In the embodiment of the invention, if the tab terminal 12 is inserted between the surface S1 facing the pair of projection portions 23*a* and 23*a* side among the surfaces S1 and S2 of the bus bar terminal 11 and the fastening clip 20, since excessively entering the fastening clip 20 into the through-opening 11*a* is restricted by the pair of projection portions 23*a* and 23*a* and the fastening clip 20 pinches the tab terminal 12 so as to come into close contact with the bus bar terminal 11, the bus bar terminal 11 and the tab terminal 12 can be connected to each other merely by inserting the tab terminal 12, and as a result, it is possible to reduce time required for connection work of a terminal.

Further, in the embodiment of the invention, since the locking hole 12*a* of the tab terminal 12 is locked by the locking fin 11*b* of the bus bar terminal 11, it is possible to position the tab terminal 12 with respect to the bus bar terminal 11 and also to prevent dislodging of the tab terminal 12 from the bus bar terminal 11.

Further, in the embodiment of the invention, since the fusible link 1 has the fastening clip 20 and the bus bar terminal 11, it is possible to reduce time required for connection work of a terminal and also to allow the bus bar terminal 11 and the tab terminal 12 which is an external terminal to be connected to each other by the fastening clip 20. Therefore, it is possible to make a compact configuration, compared to a fusible link in which a terminal is connected by a bolt and a nut.

In addition, in the embodiment of the invention, as a terminal which is connected to the tab terminal 12, the bus bar terminal 11 provided at the bus bar 2 has been exemplified. However, it is not limited thereto, and provided that it is a plate-like terminal supported by a supporting section, other terminals may also be used. For example, a terminal which is connected to an electric wire similarly to the tab terminal 12 may also be used.

In addition, in the embodiment of the invention, the terminal connection structure 10 has been exemplified in which the protruding portions 21*c* and the clip guide portions 32 are provided, so that the interval between the opposed pieces 21 and 22 of the fastening clip 20 are made so as not to excessively widen. However, it is not limited thereto, and a terminal connection structure which does not have the protruding portions 21*c* and the clip guide portions 32 may also be used.

In addition, the invention is not to be limited by the embodiment.

According to the invention, when the second terminal is inserted between the surface facing the pair of projection portions side among the surfaces of the first terminal and the clip, since excessively entering the clip into the through-opening is restricted by the pair of projection portions and the clip pinches the second terminal so as to come into close contact with the first terminal, the first terminal and the second terminal can be connected to each other only by inserting the second terminal, and as a result, it is possible to reduce time required for connection work of a terminal.

What is claimed is:

1. A terminal connection structure, comprising:

a first terminal that is made in a plate shape and formed with a through-opening;

a supporting section supporting the first terminal;

a second terminal that is made in a plate shape and to be a connection counterpart of the first terminal; and a clip made of a plate-like material having an electrical conductivity, and having a central piece formed into a U-shape and opposed pieces continued from the central piece, the central piece being provided with a pair of projection portions projected from both side portions of the central piece so as to prevent the clip from excessively entering into the through-opening;

wherein the first terminal is interposed between the opposed pieces facing to each other with the central piece inserted into the through-opening, and the second terminal is inserted between a surface of the first terminal facing the pair of projection portions and the clip.

2. The terminal connection structure according to claim 1, wherein the first terminal is a terminal provided with a bus bar.

3. The terminal connection structure according to claim 1, wherein the second terminal has a locking hole to be locked by the first terminal, and the first terminal has a locking portion to be engaged with the locking hole so as to lock the second terminal to the first terminal, and the locking portion is provided in ahead of the through-opening in an insertion direction of the second terminal.

4. A fusible link comprising the terminal connection structure according to claim 1.

* * * * *